US005395168A

United States Patent [19]

Leenen

[11] Patent Number: 5,395,168

[45] Date of Patent: Mar. 7, 1995

[54] IN THE EAR HEARING AID HAVING EXTRACTION TUBE WHICH REDUCES ACOUSTIC FEEDBACK

[75] Inventor: Joseph R. G. M. Leenen, Eindhoven, Netherlands

[73] Assignee: U.S. Philips Corporation, New York, N.Y.

[21] Appl. No.: 889,206

[22] Filed: May 27, 1992

[30] Foreign Application Priority Data

Jun. 7, 1991 [EP] European Pat. Off. ..... 91201410.7

[51] Int. Cl.[6] ..... H04R 25/00

[52] U.S. Cl. ..... 381/68.6; 381/69; 379/52

[58] Field of Search ..... 381/68.6, 68.7, 69, 381/69.1, 68, 68.3, 154, 68.2, 68.4, 93, 68.5, 187, 183; 379/52

[56] References Cited

U.S. PATENT DOCUMENTS

| | | | |
|---|---|---|---|
| 2,544,027 | 3/1951 | King | 379/52 |
| 2,659,772 | 11/1953 | O'Hara | 379/52 |
| 2,910,679 | 10/1959 | Baldwin | 381/68.7 |
| 4,852,177 | 7/1989 | Ambrose | 381/69 |
| 5,022,486 | 6/1991 | Miura et al. | 381/187 |
| 5,048,090 | 9/1991 | Geers | 381/69 |
| 5,101,435 | 3/1992 | Carlson | 381/68.6 |

FOREIGN PATENT DOCUMENTS

| | | | |
|---|---|---|---|
| 0288489 | 3/1991 | Germany | 381/68 |
| 0135845 | 5/1990 | Japan | 379/52 |

*Primary Examiner*—Curtis Kuntz
*Assistant Examiner*—Huyen D. Le
*Attorney, Agent, or Firm*—Bernard Franzblau

[57] ABSTRACT

An in-the-ear canal hearing aid comprises a housing which accommodates a microphone, an amplifier and an electromechanical transducer (for example, of a telephone) which are electrically coupled together in cascade. The hearing aid further includes an extraction element for extracting the hearing aid from the ear canal. The extraction element is in the form of a hollow tube having one end mechanically attached to the housing of the hearing aid at such a position that the channel in the tube is acoustically coupled to the sound entrance of the hearing aid. As a result, a second function of the extraction element is the suppression of acoustic feedback.

19 Claims, 1 Drawing Sheet

IN THE EAR HEARING AID HAVING EXTRACTION TUBE WHICH REDUCES ACOUSTIC FEEDBACK

BACKGROUND OF THE INVENTION

This invention relates to a hearing aid intended for to be mounted within an ear canal, comprising a microphone, an amplifier and an electromechanical transducer, for example, a telephone, accommodated in a housing, and including an extraction means for extracting the hearing aid from the ear canal, the input to the microphone being acoustically coupled to a sound entrance in the housing.

Such a hearing aid is known from U.S. Pat. No. 4,756,312. A contact hearing aid is discussed there in which the electromechanical transducer is in the form of a piezoelectric element generating vibrations which are transferred directly to the tympanic membrane. For this purpose, the hearing aid is to be mounted deep within the ear canal. It is more customary for the transducer to have the form of a telephone (loudspeaker) with which acoustic signals are generated which strike the tympanic membrane. In this embodiment too there are hearing aids which are to be mounted deep within the ear canal. For extracting such hearing aids from the ear canal, the hearing aids comprise extraction means.

The extraction means in the prior art hearing aid is in the form of a rod of ferromagnetic material which at one end cooperates with a magnet and at the other end is capable of cooperating with a magnetic ring attached to the housing of the hearing aid. The magnet may be disposed in two positions relative to the rod. In one position of the magnet the hearing aid may be extracted from the ear canal by means of the magnetic force exerted on the ring of the hearing aid by the other end of the rod. In the other position of the magnet the rod can, prior to the hearing aid being extracted, be inserted into the ear canal without a force being exerted on the heating aid by the rod. The prior art hearing aid thus has the drawback of requiring a separate accessory for extracting the hearing aid. It is known to use, in lieu of a separate accessory, a component which is mechanically, hinged or not, coupled to the housing.

SUMMARY OF THE INVENTION

It is an object of the invention to propose a different type of extraction means so that a separate accessory is not required either.

The hearing aid according to the invention is thereto characterized in that the extraction means is in the form of a hollow tube whose one end at the sound entrance is mechanically coupled to the housing so that the sound entrance is acoustically coupled to the channel in the acoustic tube.

The measure according to the invention is based on the recognition that with respect to the extraction means a choice is to be made so that further problems that also may occur with a heating aid can be remedied simultaneously. The fact is that a further problem often occurring with hearing aids is the acoustic feedback. In that case there is too strong a sound transfer from the telephone to the input of the microphone, which causes acoustic feedback. According to the invention the extraction means in the form of a tube is furthermore used as an acoustic guide of external sound to the microphone input. The acoustic feedback path is thereby extended by roughly twice the length of the tube, which means that a further suppression of undesired oscillations can be realized. The acoustic tube thus has a twofold object. On the one hand the tube serves as an extraction mechanism and on the other hand the tube serves as a means for further suppressing acoustic feedback.

There is an additional advantage if the tube is made of a flexible material. In that case the acoustic feedback, which especially occurs if a switched-on hearing aid is extracted, may be avoided by pinching the tube while the hearing aid is being inserted or extracted.

BRIEF DESCRIPTION OF THE DRAWING

The invention will be further explained in the following description of the drawings with reference to an exemplary embodiment, in which.

DESCRIPTION OF THE PREFERRED EMBODIMENTS

Figure 1:
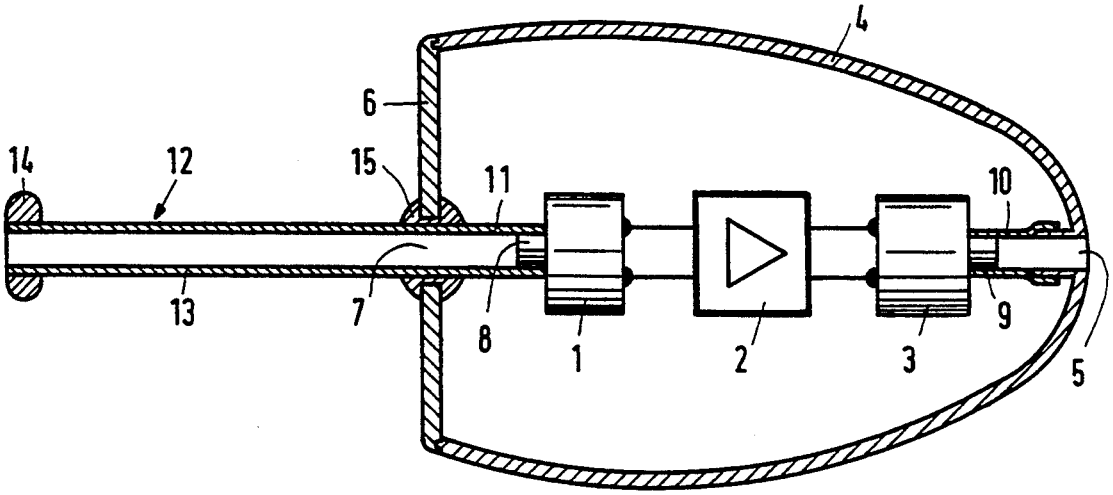
FIG. 1 shows a first exemplary embodiment.

FIG. 1 shows a diagram of a hearing aid which can be mounted within the ear canal, a so-called in-the-ear canal hearing aid. The hearing aid comprises a microphone 1, an amplifier 2 and an electromechanical transducer 3 which are all accommodated in a housing 4. The housing 4 has an external shape adapted to the internal shape of the ear canal of the user of the hearing aid. The transducer 3 is a telephone (loudspeaker) in the present example. The hearing aid is inserted into the ear canal in such a way that the sound exit 5 of the hearing aid is directed towards the tympanic membrane. The sound output 9 of the telephone 3 is acoustically coupled to the sound exit 5 by way of a tube 10. The housing 4 is shut off by a cover 6 on the side remote from the tympanic membrane. In this cover there is a sound entrance 7 which is acoustically coupled to the sound input 8 of the microphone 1 by means of an acoustic tube 11. The cover 6 may comprise still more components of the hearing aid, such as a volume control, and it may have an opening for inserting a battery, which opening may be closed by a button (not shown).

The hearing aid further includes an extraction means 12. The extraction means 12 is in the form of a hollow tube 13. One end of the tube 13 is acoustically coupled to the sound entrance 7 in the cover 6. This one end of the tube 13 is furthermore mechanically attached to the cover 6 by means of a grommet 15. The other end of the tube 13 has a thickening 14.

The length of the tube 13 is such that the user can pull the heating aid out by the thickening if the hearing aid is embedded in the ear canal. The tube 13 furthermore serves as an acoustic tube through which the external sound signals can be fed to the sound entrance 7 and thus to the microphone 1. The tube 13 extends the acoustic transfer path from the telephone 3 to the input 8 of the microphone 1 so that there is less chance of acoustic feedback. The tube 13 thus not only serves as an extraction means but also as a means for suppressing acoustic feedback.

The tube 13 may be made of a rigid or a flexible material. In the latter case one can use, for example, a piece of silicone hose.

Figure 2:
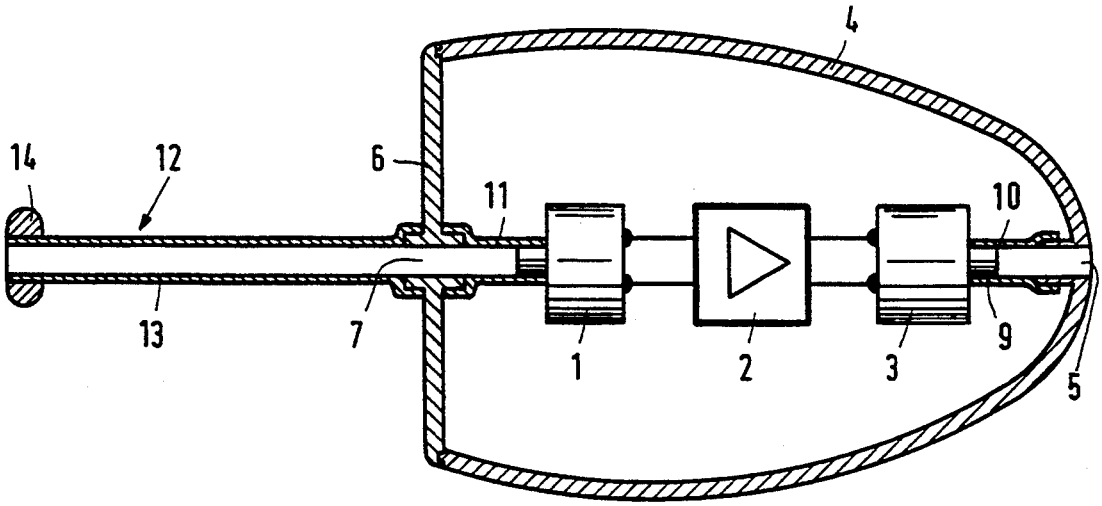
FIG. 2 shows a second exemplary embodiment.

In the exemplary embodiment shown in FIG. 1 the tubes 11 and 13 are arranged as a single tube. FIG. 2 shows a somewhat different embodiment in which the tube 13 and the tube 11 do not form one whole but are each connected to the cover 6. In either case, the extraction tube is mechanically fixed or fastened to the cover of the housing or to the housing itself.

I claim:

1. A hearing aid intended for placement within an ear canal, comprising: a microphone, an amplifier and an electromechanical transducer coupled together in cascade and accommodated within a housing, and an extraction means for extracting the hearing aid from the ear canal, the input to the microphone being acoustically coupled to a sound entrance in the housing, wherein the extraction means comprises a hollow acoustic tube having one end located at the sound entrance of the housing and mechanically coupled to the housing so that the sound entrance is acoustically coupled to a channel in the acoustic tube.

2. A hearing aid as claimed in claim 1, wherein the tube is made of a flexible material.

3. A hearing aid as claimed in claim 2, wherein the other end of the acoustic tube comprises a gripping means.

4. A hearing aid as claimed in claim 1, wherein said acoustic tube is mechanically coupled to the housing by means of a fixed permanent mechanical coupling and the other end of the acoustic tube comprises a gripping means.

5. A hearing aid as claimed in claim 1, wherein said hollow tube extends outside of the housing and said electromechanical transducer comprises a telephone device.

6. A hearing aid as claimed in claim 1 wherein said housing is shaped so as to fit within an ear canal of a user of the hearing aid and the housing has a sound exit opening in a part thereof which is opposite to the part of the housing at which said sound entrance is located.

7. A hearing aid as claimed in claim 6 further comprising a further hollow tube located within the housing and arranged to couple a sound output of the electromagnetic transducer to the sound exit opening in the housing.

8. A hearing aid as claimed in claim 1 wherein the other end of the hollow tube is open so as to receive external sound waves intended for the input of the microphone.

9. An in-the-ear hearing aid comprising:

a housing having a sound entrance, a microphone, an amplifier and an electromagnetic transducer electrically coupled together in cascade and mounted within said housing and with an input of the microphone acoustically coupled to the sound entrance of the housing, and means for extracting the hearing aid from an ear canal, wherein said extracting means comprises a hollow tube forming an acoustic channel and with one end of the hollow tube mechanically coupled to the housing at the sound entrance so that the sound entrance is acoustically coupled to the acoustic channel in the hollow tube and is sealed off from sound waves other than those received by the acoustic channel in the hollow tube.

10. A hearing aid as claimed in claim 9 wherein the hollow tube extends outside of the housing in a line approximately straight back from the housing of the hearing aid thereby to extend the sound path from an acoustic output of the housing to an acoustic input of the hollow tube.

11. A hearing aid as claimed in claim 10 wherein the hollow tube is made of a flexible material.

12. A hearing aid as claimed in claim 10 wherein said acoustic input of the hollow tube comprises an opening in the other end of the hollow tube whereby the hollow tube provides a second function, suppression of acoustic feedback from said acoustic output of the housing to said opening in the other end of the hollow tube.

13. A hearing aid as claimed in claim 9 wherein the hollow tube is mechanically coupled to the housing in a fixedly attached manner and a sound output of the electromagnetic transducer is acoustically coupled to a sound output in the housing.

14. A hearing aid as claimed in claim 9 wherein an acoustic input end of the hollow tube comprises a gripping means to facilitate extraction of the hearing aid from an ear canal.

15. A hearing aid as claimed in claim 9 wherein the hollow tube is made of a flexible material.

16. A hearing aid as claimed in claim 9 wherein the hollow tube extends through the sound entrance in the housing and is mechanically coupled directly to the input of the microphone.

17. A hearing aid as claimed in claim 9 wherein the housing and hollow tube form an undivided unitary structure.

18. A hearing aid as claimed in claim 9 wherein said housing is shaped so as to fit within an ear canal of a user of the hearing aid and the housing has a sound exit opening which will face the tympanic membrane in the ear canal of the user when the housing is positioned within said ear canal.

19. A hearing aid as claimed in claim 9 wherein the other end of the hollow tube is open so as to receive external sound waves which will pass through said acoustic channel and said housing sound entrance to the input of the microphone.

* * * * *